United States Patent [19]

Ogura

[11] Patent Number: 4,752,028

[45] Date of Patent: Jun. 21, 1988

[54] PACKAGING BOX HAVING A TEAR PREVENTION STRUCTURE

[75] Inventor: Yoshiharu Ogura, Osaka, Japan

[73] Assignee: Ogura Art Printing Co. Ltd., Yao, Japan

[21] Appl. No.: 35,891

[22] Filed: Apr. 8, 1987

[30] Foreign Application Priority Data

May 13, 1986 [JP] Japan ..... 61-71776
May 13, 1986 [JP] Japan ..... 61-71777
Sep. 17, 1986 [JP] Japan ..... 61-217032

[51] Int. Cl.[4] ..... B65D 5/02

[52] U.S. Cl. ..... 229/102; 206/628; 229/153

[58] Field of Search ..... 206/628, 621, 491, 620; 229/126, 127, 148, 157, 158, 195, 197, 905, 177, 188, 153, 102

[56] References Cited

U.S. PATENT DOCUMENTS

| | | | |
|---|---|---|---|
| 2,160,164 | 5/1939 | Palmer | 229/153 |
| 3,112,854 | 12/1963 | Person | 229/148 |
| 3,140,811 | 7/1964 | Hall et al. | 229/148 |
| 3,705,681 | 12/1972 | Rossi et al. | 206/491 |
| 4,131,229 | 12/1978 | Nastasi | 229/153 |
| 4,487,359 | 12/1984 | Hemmeter | 206/628 |

*Primary Examiner*—Willis Little
*Attorney, Agent, or Firm*—Holman & Stern

[57] ABSTRACT

The present invention relates to a packaging box with a cover plate and base plate for closing the top and bottom openings of a quadrangular cylindrical body for holding medical supplies or the like, and provides a tear prevention function to keep the medical supplies or the like held inside the box out of risks of mischief and pilferage.

9 Claims, 12 Drawing Sheets

PACKAGING BOX HAVING A TEAR PREVENTION STRUCTURE

BACKGROUND OF THE INVENTION

The present invention relates to a packaging box, and in particular to packaging box having a structure allowing no contingent tear.

Generally, the structure of packaging box forms a body of box in a quadrangular cylindrical body with a front and back plate and a left and right side plate and adopts a structure to provide a cover plate and base plate, which blocks off openings formed respectively at opposite top and bottom ends of the cylindrical body, to lead connectively to the opposite top and bottom sides of the front plate forming the cylindrical body allowing the cover plate and base plate by folding the same to open and close the openings.

Among these packaging boxes, particularly if the use is for packaging box to hold medical supplies or the like, it is considered necessary to provide a tear prevention function in order to prevent such risks as mischief or pilferage made against the contents.

For this purpose, pharmacists add a structure to give a function of tear or conversion prevention to the box and pay a lot of attention to the cover plate and base plate portion which can most easily be tricked for tearing.

The prior structure for preventing tear and conversion, however, mostly adopts a double construction in the cover plate and base plate portion thereby a tear mark could easily be detected if the box should be torn, but in this case, besides the structure being complicated, it is a defect that a risk still remains for the contents being taken out without giving any damage to the cover plate or base plate when they are torn carefully by means of a sharp knife or the like at the portion (overlap width) on which an adhesive is spread.

SUMMARY OF INVENTION

The object of the present invention is to solve the above mentioned problems, construct an adherend surface, to which an overlap width portion of an insert tongue arranged to lead connectively to the tip of cover plate and base plate is bonded, as a surface which can not be touched at all from outside once the box is fabricated, and add a function of conversion and tear prevention thereby provide a packaging box which can further guarantee safety control of the contents.

The means of the present invention comprises a box body of such structure as to shut-off the opposite top and bottom ends of cylindrical body with a cover plate and base plate, and provides an inwardly foldable shut-off contact plate to lead connectively to the top end or bottom end of wall surface positioned in the front of the side toward which an insert tongue folded at the tip of the cover plate or the base plate of the cylindrical body is tucked in thereby an insert hole is formed for inserting therein the insert tongue at the tip of the cover plate and base plate and bonding the back of the tongue thereon.

BREIF DESCRIPTION OF THE DRAWINGS

FIG. 1 of the drawings is an expanded plan view showing a first embodiment of packaging box with a tear prevention structure in relation to the present invention.

BEST MODE OF CARRYING OUT THE INVENTION

Figure 1:
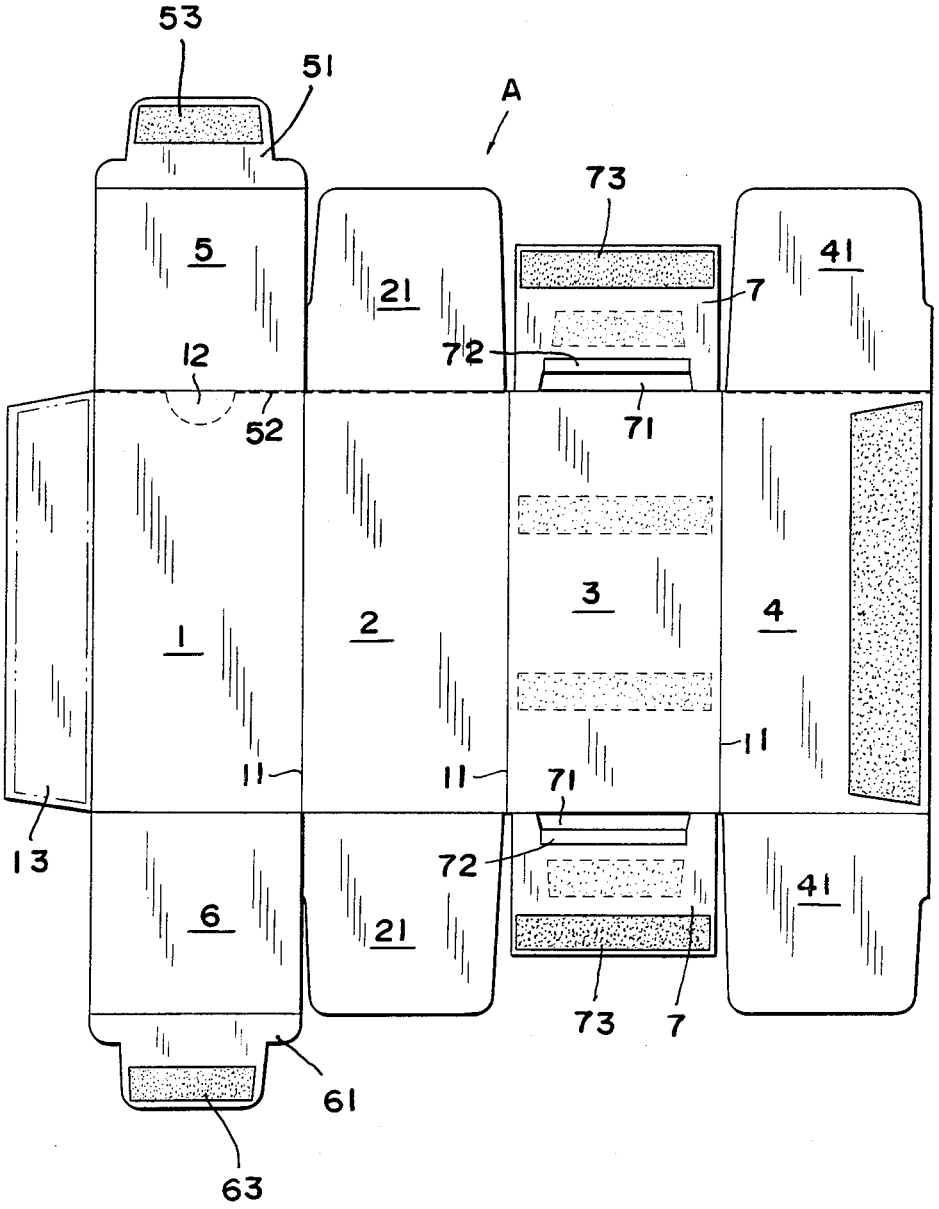

In the following, the first embodiment will be described with reference to FIG. 1 to FIG. 5.

The box body A of the present invention is constructed to provide a front plate 1, a left side plate 2, a back surface plate 3 and a right side plate 4 in a line connectively putting folds 11, 11,—between each of the plates, and provide connectively a cover plate 5 and a base plate 6 foldably at the top end and at the bottom end respectively of the front plate 1, having tongue flaps 51, 61 respectively at the tip of the cover plate 5 and base plate 6 and also provide each of the folding flaps 21 to lead at the top and bottom end oppositely to the left side plate 2 and likewise each of folding flaps to lead at the top and bottom end oppositely to the right side plate 4, on which a mounting flap 13 arranged adjasently to the front plate 1 is bonded by means of adhesive to construct a cylindrical body. Thus, the plates 1,2,3,4 constitute respective body panels and the plates 5 and 6 constitute respective closure panels.

In this embodiment, shut-off plates 7, 7 are provided to lead connectively to the top and bottom end of the back surface plate 3, so as to be folded inwardly for contacting and bonding by an adhesive layer 73, while the contact plate 7, 7 form insert holes 71, 71 into which insert tongue flaps 51, 61 connected in the border of the back surface plate 3 to the cover plate 5 and base plate 6 respectively are inserted. The contact plates 7, 7 also form guide-standing flaps 72, 72 at their lower edges so that the tips of tongue flaps 51, 61 can easily be inserted into the insert holes 71, 71 of the contact plates 7, 7 mounted to the inner surface of the back surface plate 3. Then, adhesive is applied to the back surface of the insert flaps 51, 61 to contact and bond the insert flaps inserted into the insert holes 71, 71 onto the inner surface of the contact plates 7, 7 by means of the adhesive layers 53, 63.

Figure 2:
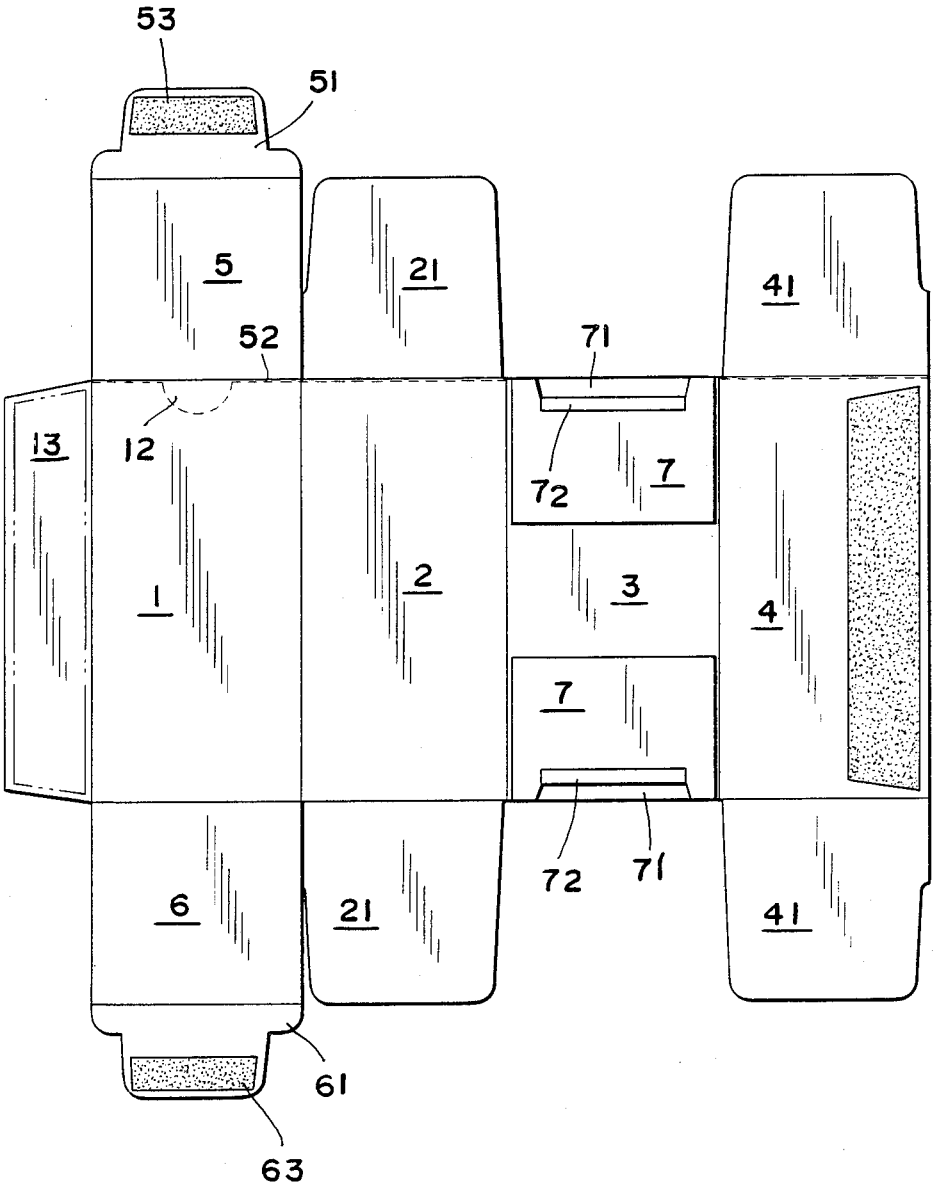
FIG. 2 is an expanded plan view of an inwardly foldable shut-off contact plate folded and mounted making contact.
Figure 3:
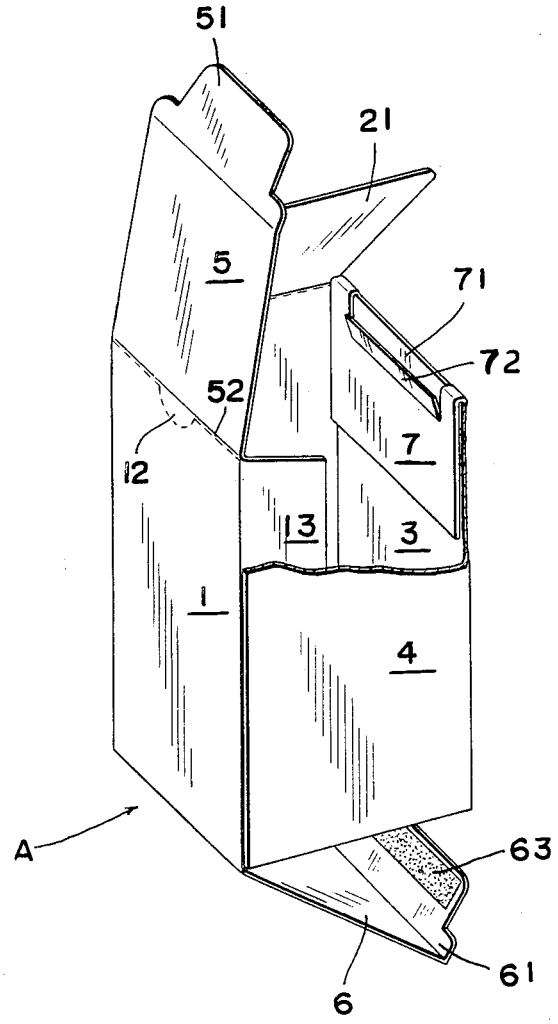
FIG. 3 is a partially cutaway perspective view under fabrication
Figure 4A:
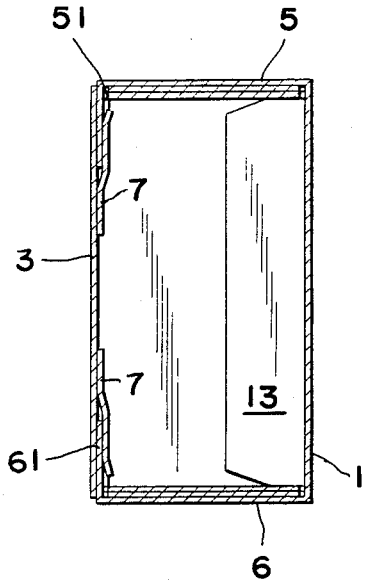
FIG. 4(*a*) is a longitudinal sectional side view and FIG. 4(*b*) is a perspective view of the important part of FIG. 4(*a*).
Figure 4B:
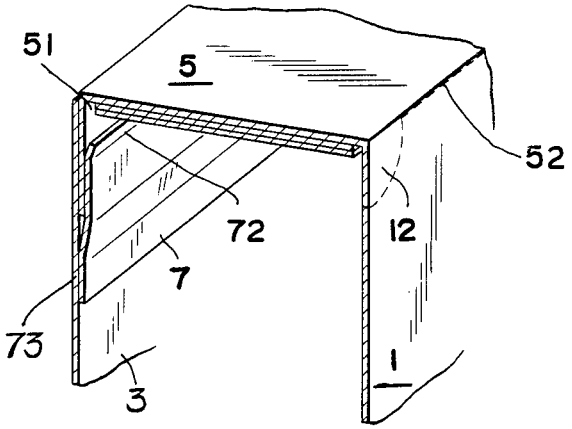
Figure 5:
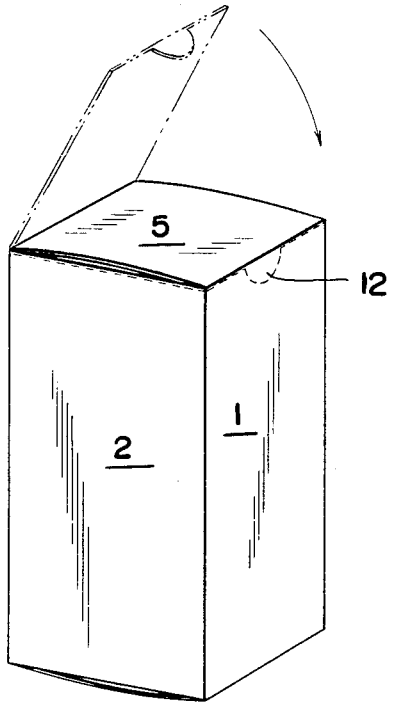
FIG. 5 is a perspective view showing an opened state of a cover plate cut at perforation.
Figure 6:
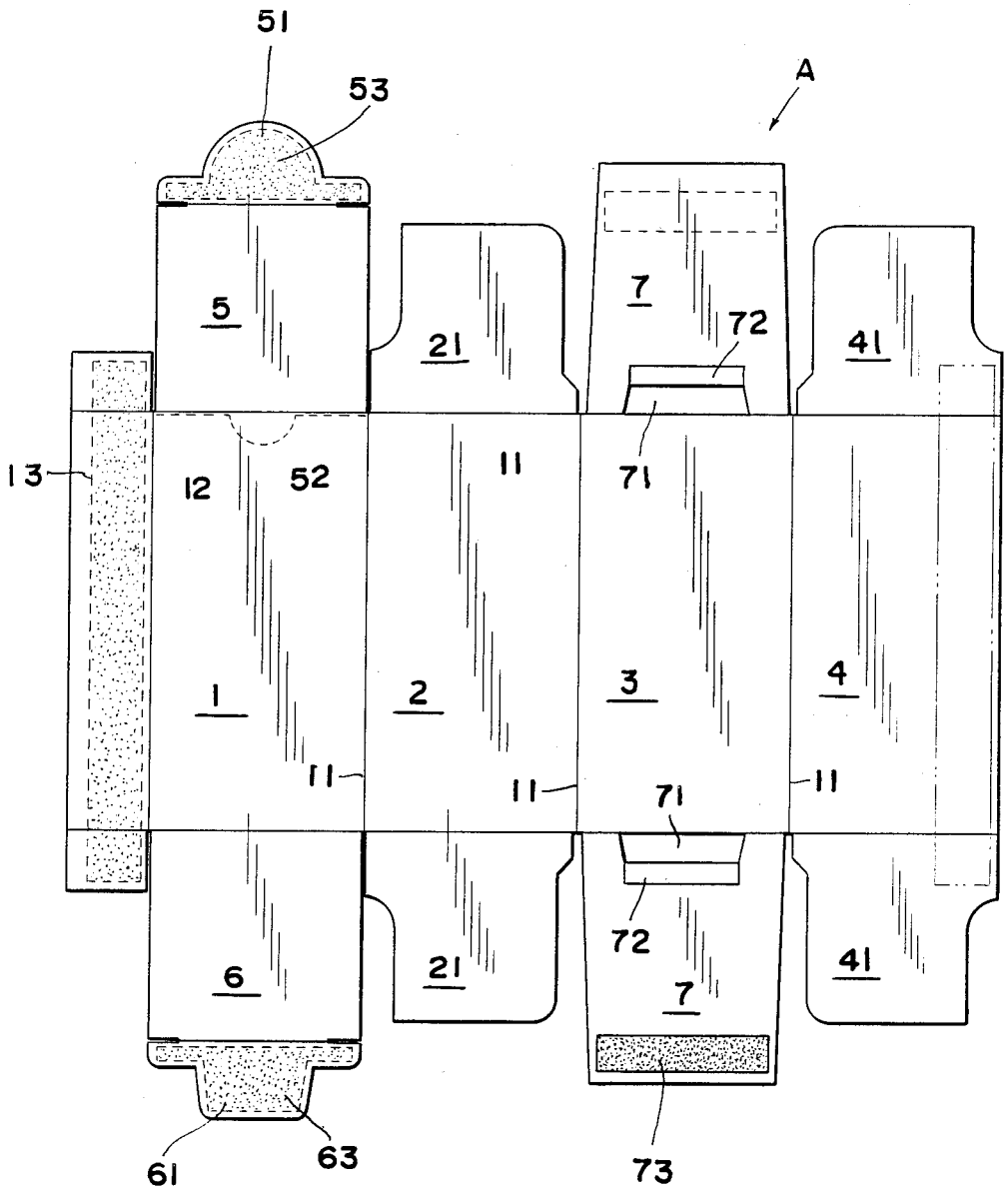
FIG. 6 is an expanded plan view of a second embodiment.
Figure 7:
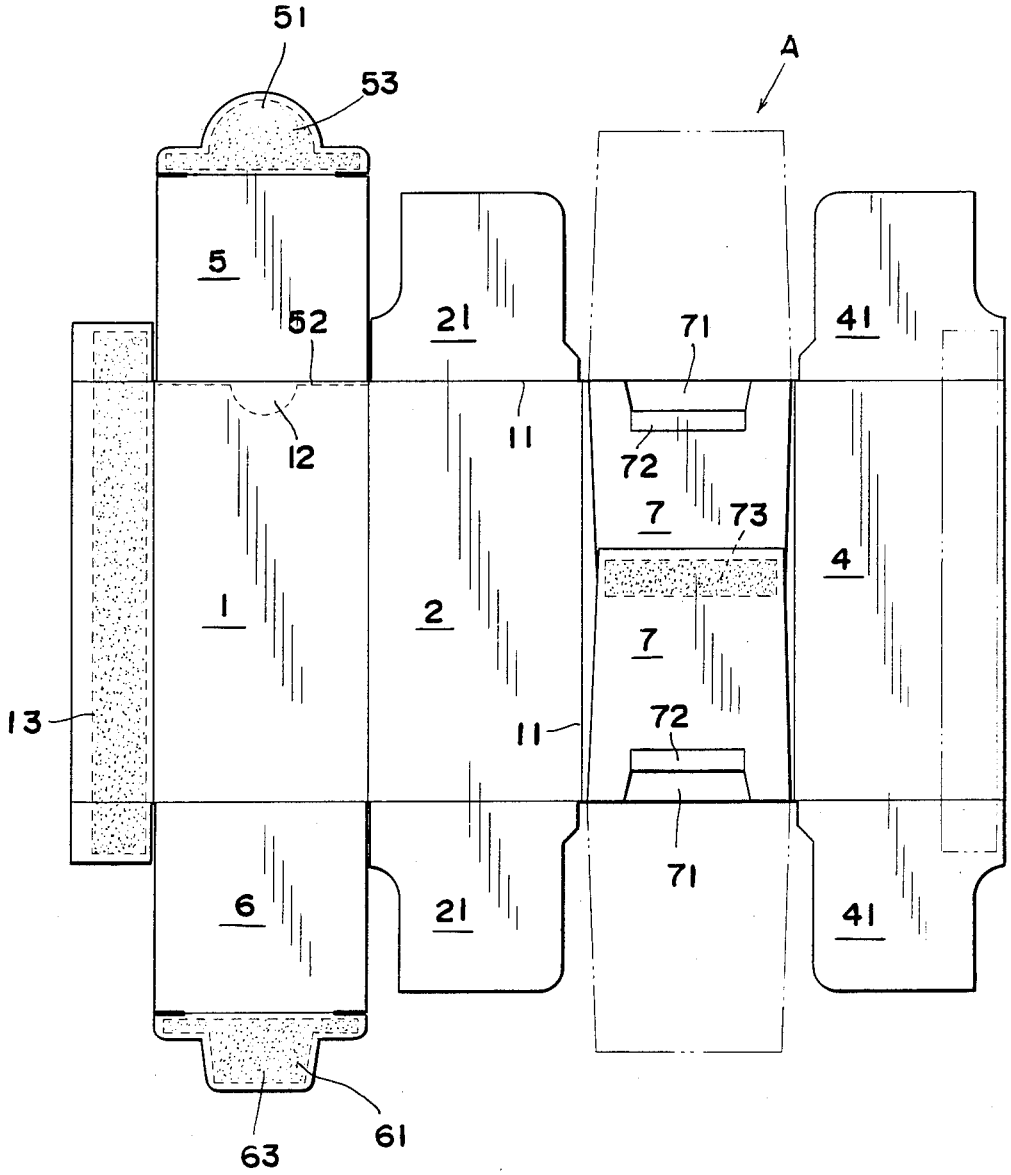
FIG. 7 is an expanded plan view of the shut-off contact plate folded and mounted making contact.
Figure 8:
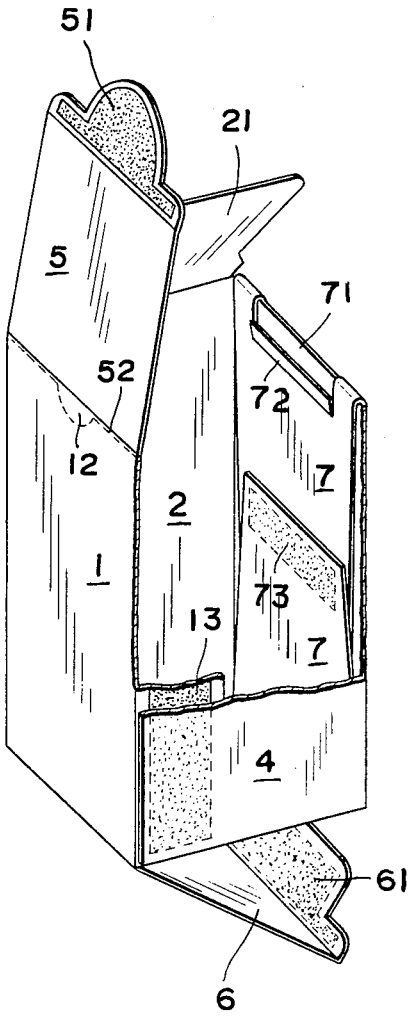
FIG. 8 is a perspective view under fabrication.
Figure 9A:
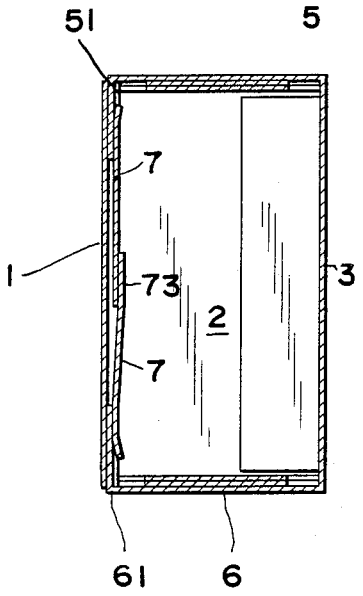
FIG. 9(*a*) is a longitudinal sectional side view and FIG. 9(*b*) is a perspective view of the important part of FIG. 9(*a*).
Figure 9B:
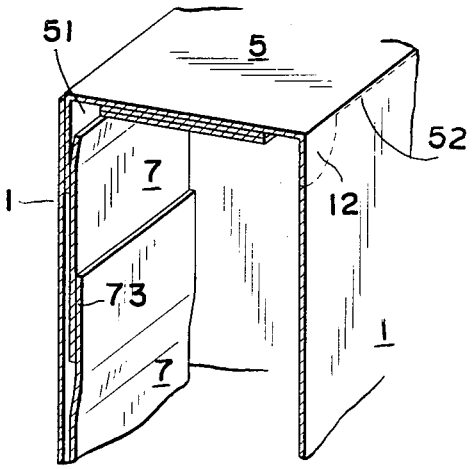
Figure 10:
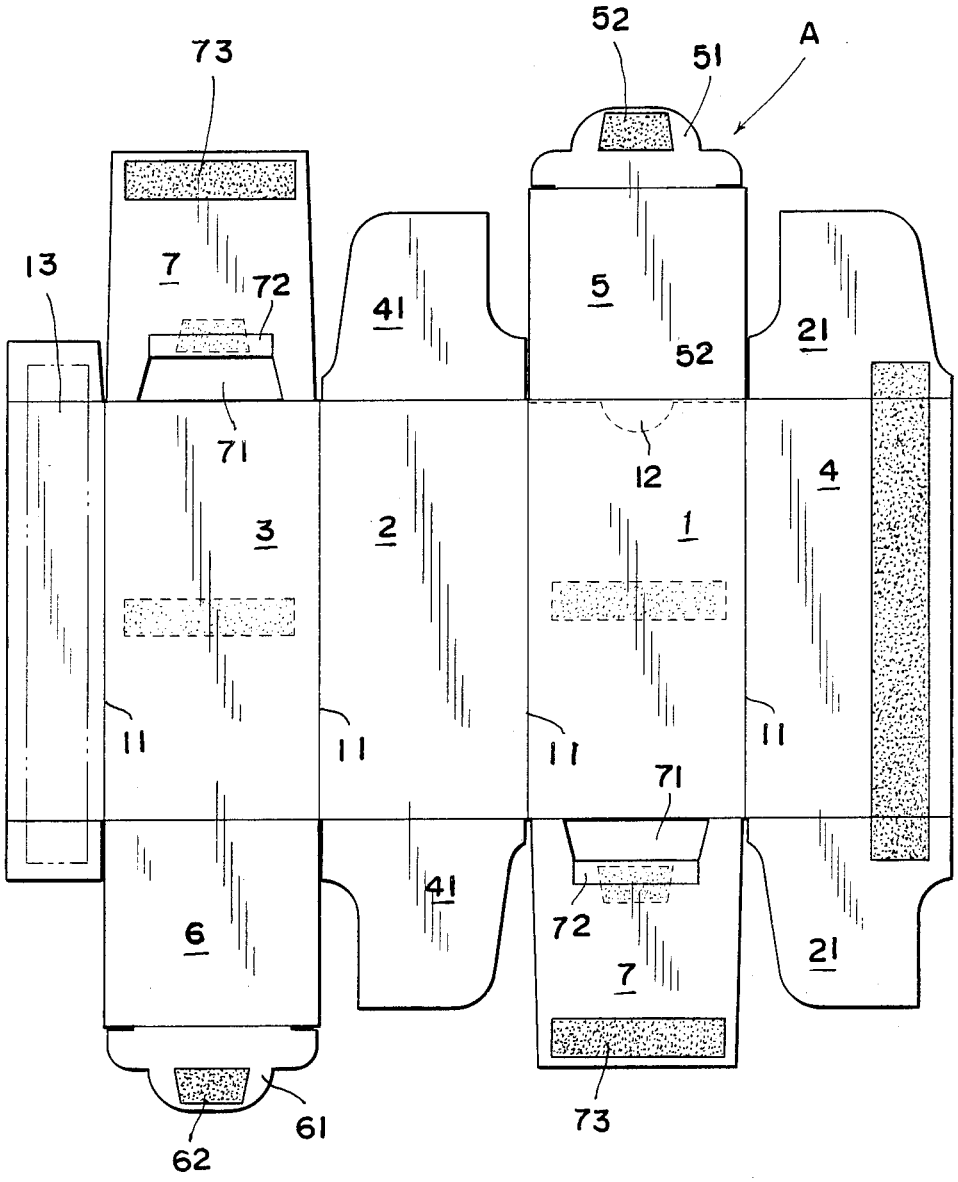
FIG. 10 is an expanded plan view showing a third embodiment.
Figure 11:
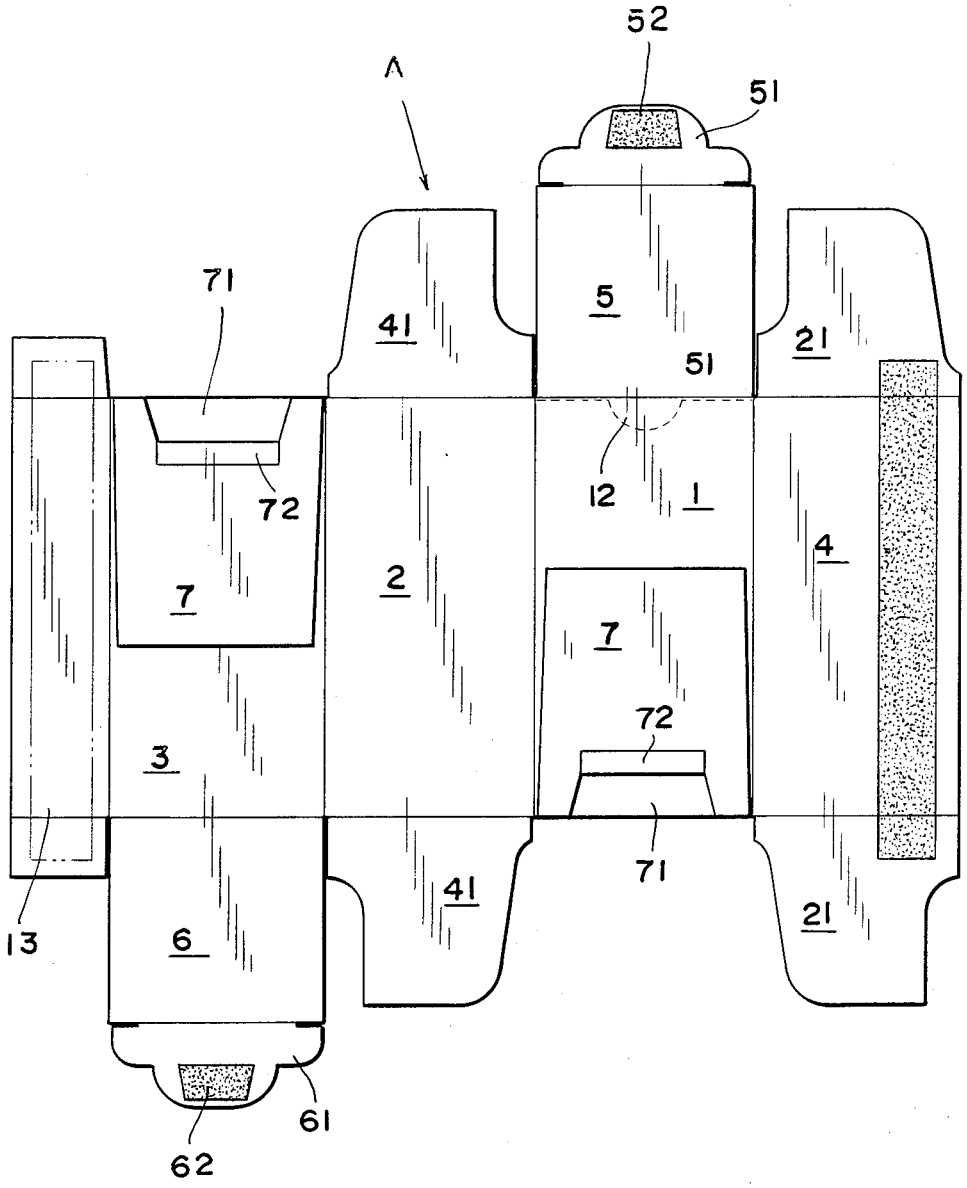
FIG. 11 is an expanded plan view showing particularly the shut-off contact plate only folded and mounted making contact.
Figure 12:
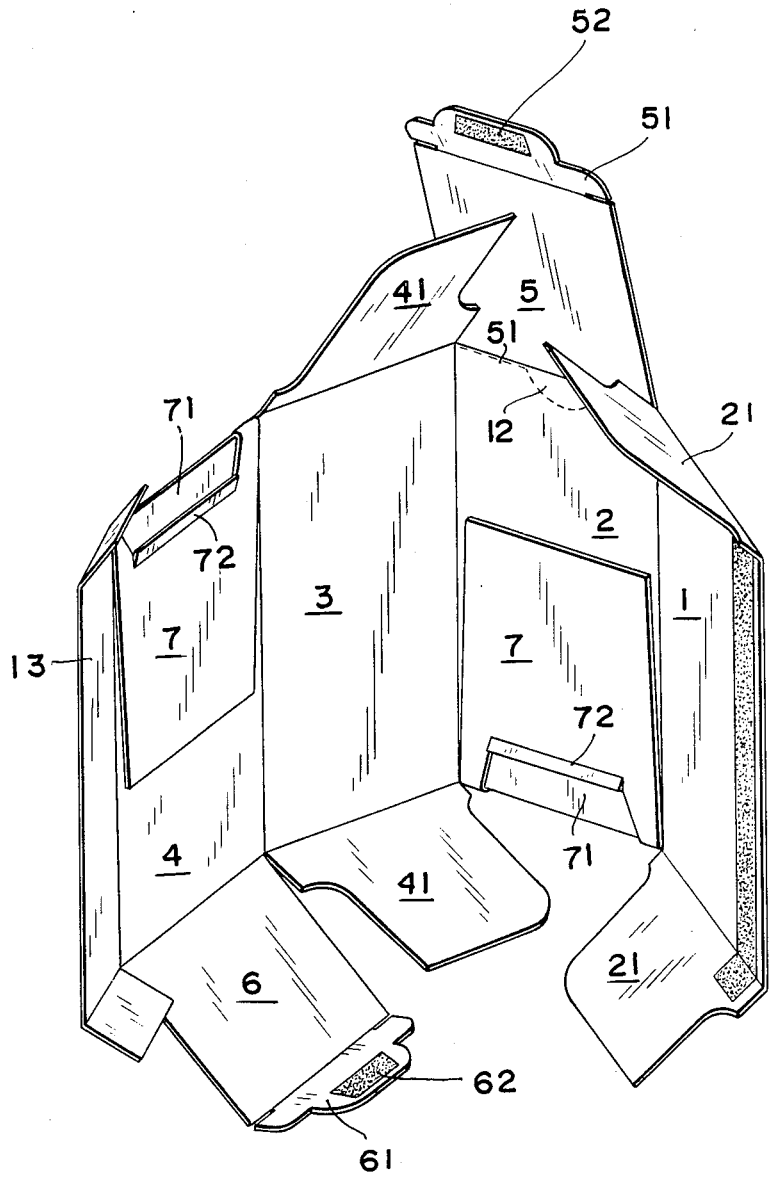
FIG. 12 is a perspective view under fabrication.
Figure 13A:
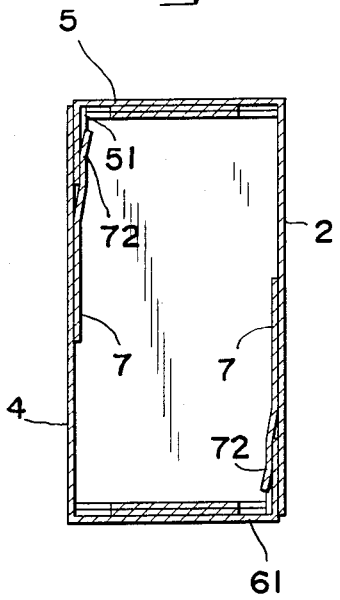
FIG. 13(*a*) is a longitudinal sectional side view and FIG. 13(*b*) is a perspective view of the important view of FIG. 13(*a*).
Figure 13B:
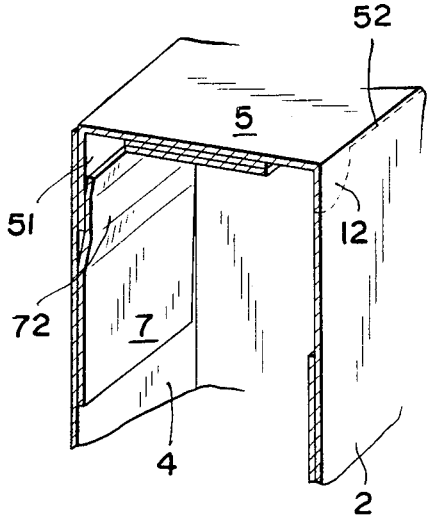

As shown in FIG. 2, in the box body A of the above mentioned structure, the shut-off contact plates 7, 7 at the top and bottom end of the back surface plate 3 are folded inwardly of the back surface plate 3 beforehand and adhesive layers 73, 73 (see FIG. 1) applied at the end of the back surface plate are mounted to an opposite surface of the back surface to make them up into a cylindrical body by, as in the case of fabricating a conventional cylindrical body, folding the front plate 1, back plate 3, and left and right side plates 2, 4 along the folds 11, 11—and by mounting flaps 73, 73 to a back surface of the right side plate by means of adhesive, then inwardly laying the folding flaps 21, 41 respectively before closing the openings with the cover plate and base plate respectively. On this occassion the tongue flaps 51, 61 provided at the tips of the cover plate and base plate are inserted into the insert holes 71, 71 of the shut-off contact plates 7, 7 to bond the tongue flaps on the contact plates 7, 7 by the adhesive coated surface 53, 63 applied to the back surface of the tongue flaps for complete fabrication and sealing. When the body needs to be torn after sealed, as shown in FIG. 5, it can be released by cutting out a cut perforation 52 formed in the border of the cover plate 5 and front plate 1 and by pulling up a cutout portion 12 in the middle of the perforation 52. Cutting out the perforation, however, does not allow any repeated shut-off of the cover plate 5.

Then, in a secound embodiment shown in FIG. 6 to FIG. 9, each of contact plates 7, 7 is constructed to give a lenght so that the tips of each other's can be lapped and bonded to be mounted independently of a back surface plate 3 thereby giving elasticity throughout the both contact plates 7, 7 so as thereby to produce a relief effect to give a space, although it is a little, between the back surface plate and the contact plate keeping them apart so as to insert tongue flaps 51, 61 easily into insert holes 71, 71.

Further, in a third embodiment of FIG. 10 to FIG. 13, a cover plate 5 is arranged to lead connectively to the top end of a front plate 1 while a back surface plate 6 is arranged to lead connectively to the bottom end of a back plate 3 also while shut-off contact plates 7, 7 are arranged to lead connectively to the bottom end of the front plate 1 and to the top end of the back surface plate 3 respectively and further fold flaps 21, 21 and 41, 41 are arranged to lead connectively to a right side plate 4 and a left side plate 2 respectively, namely, because an offset placing of the shut-off contact plates 7, 7 in the box body in a manner different from the second embodiment, it eliminates such fear as a mounted portion of the lower contact plate and the shut-off tongue flaps are separated with a sharp point of a paper-knife or the like inserted from the top end, and the upper mounted portion is separated with a reverse operation. Other structures are the same as the previous embodiments.

According to the present invention, as the back surface (adhesive coated surface) of the shut-off tongue flaps 51, 61 are bonded on the back surface of the shut-off contact plates 7, 7 even if edge tools of knife or the like are inserted from the mounting base-end side of the shut-off tongue flaps into the fabricated box for the purpose of tearing, the edge tools can not touch the adhesive coated surface at all and no fear of tearing. The box body can, therefore, be constructed in a way completely similar to the conventional boxes except adding the shut-off contact plates 7, 7 and an automatic fabrication can also be conducted.

What is claimed is:

1. A blank of sheet material for folding into a tamper-resistant box, the blank comprising four side-by-side body panels with fold lines therebetween for folding the panels to provide a box body in the form of a parallelopiped, the respective panels having in-line first ends and in-line second ends, means for securing the panels together when folded to form the box body, a closure panel extending from the first end of one of said body panels with a fold line therebetween, a foldable tongue extending from a free end of the cover panel, a shut-off panel extending from the second end of another of said body panels separated from said one of the body panels by still another of the body panels, the shut-off panel being foldable inwardly toward a surface of said another of said body panels, first adhesive means for securing a free end of the shut-off panel in substantially face-to-face relation with said surface of said another of said body panels, slit defining means in the shut-off panel adjacent said another of said body panels for insertion of said tongue when the blank is folded to form a box, and second adhesive means for securing the tongue when inserted through the slit defining means between the shut-off panel and said another of said body panels.

2. A blank as defined in claim 1 wherein the shut-off panel includes a guide flap for the tongue extending from one edge of the slit defining means.

3. A blank as defined in claim 1 wherein the fold line between the closure panel and said one of the body panels is perforated for opening the box.

4. A blank as defined in claim 3 including a perforated indent extending from said fold line into said one of the body panels.

5. A blank as defined in claim 1 wherein the closure panel and tongue are replicated at the second end of said one of the body panels, and wherein the shut-off panel and slit defining means are replicated at the first end of said another of said body panels.

6. A blank as defined in claim 5 wherein the respective shut-off panels have a length for adhereing same individually to said surface of said another body panel.

7. A blank as defined in claim 5 wherein the respective shut-off panels have a length for adhereing one of the shut-off panels to the other of the shut-off panels in face to face relation with said surface of said another of said body panels.

8. A blank as defined in claim 1 wherein the closure panel and tongue are replicated at the first end of said another of said body panels, and wherein the shut-off panel and slit defining means are replicated at the second end of said one of the body panels.

9. A box formed from a blank as defined in claim 1.

* * * * *